US008829824B2

(12) United States Patent
Scott

(10) Patent No.: US 8,829,824 B2
(45) Date of Patent: Sep. 9, 2014

(54) NESTING STEMWARE DRINKING VESSEL

(76) Inventor: Donald Allen Scott, Spokane Valley, WA (US)

( * ) Notice: Subject to any disclaimer, the term of this patent is extended or adjusted under 35 U.S.C. 154(b) by 0 days.

(21) Appl. No.: 13/136,009

(22) Filed: Jul. 20, 2011

(65) Prior Publication Data

US 2013/0020333 A1 Jan. 24, 2013

Related U.S. Application Data

(60) Provisional application No. 61/400,115, filed on Jul. 21, 2010.

(51) Int. Cl.
*A47G 19/22* (2006.01)

(52) U.S. Cl.
USPC ..... 315/377

(58) Field of Classification Search
USPC ..... 215/10, 376, 377, 395, 396; 220/568
See application file for complete search history.

(56) References Cited

U.S. PATENT DOCUMENTS

| | | | | |
|---|---|---|---|---|
| 83,341 | A | 10/1868 | Towndrow | |
| 2,996,208 | A | 8/1961 | Schroeder | |
| 3,369,687 | A | 2/1968 | Walls | |
| 6,164,473 | A | 12/2000 | Waldrip | |
| 7,861,888 | B2 * | 1/2011 | Niedzwiecki | 220/703 |
| 2005/0092759 | A1 | 5/2005 | Willat et al. | |
| 2005/0139570 | A1 | 6/2005 | Lambert et al. | |
| 2008/0264958 | A1 | 10/2008 | Blake | |
| 2011/0174763 | A1 * | 7/2011 | Kennedy | 215/377 |

FOREIGN PATENT DOCUMENTS

GB 2370555 A * 7/2002

* cited by examiner

*Primary Examiner* — Mickey Yu
*Assistant Examiner* — Allan Stevens
(74) *Attorney, Agent, or Firm* — William A. Jeckle

(57) ABSTRACT

A nesting stemware drinking vessel generally provides a body and a base releasably interconnectable in at least two configurations, a first configuration forming conventional stemware vessel for containing and drinking liquids and a second configuration wherein portions of the base are enclosed within an interior volume defined by the body to minimize space required for storage of the base and body to eases transport and minimizes the risk of breakage when not in use. Plural locking protrusions on an upper surface of the base releasable frictionally engage with a circumferentially extending inner lip of an aperture of the body.

7 Claims, 8 Drawing Sheets

NESTING STEMWARE DRINKING VESSEL

RELATED APPLICATIONS

This non-provisional application claims priority to provisional application No. 61/400,115 filed Jul. 21, 2010 by Donald Allen Scott for the same titled invention: Nesting Stemware Glass.

FIELD

The present invention relates to bottles, jars and receptacles, and more specifically to drinking vessels having a base and a volume defining body for containing liquids which are detachable from each other respectively. A base and a body can be attached in at least two configurations, a first configuration resembling conventional drinking vessel which is conducive to drinking liquids from the volume defining body and a second nested configuration that minimizes the space required for storage of the base and body and reduces the risk of breakage when not in use such as during transport.

BACKGROUND

Stemware is available in a variety of shapes and sizes and may be used for purposes such as carrying, serving, or drinking beverages. For example when consuming wine, champagne, beer, brandy, or cocktails, stemware is often used not only as means for drinking such a beverage, but also as a means of increasing the rate of oxidation and inducing heightened aromas.

One of stemware's uses is in the consumption of wine, where it is generally recognized that olfactory, visual and taste characteristics of any given wine are best displayed and best judged in a traditional transparent wine glass. Conventional wine glasses typically have a foot, a stem, and a bowl defining an interior volume where the bowl is of a parabolic shape.

Stemware glasses are available in many different shapes and sizes, and frequently the shape and size is dependent upon the liquid intended to be served using the particular stemware glass. For instance, stemware glasses for red wine typically have a bowl with a larger diameter than those stemware glasses used for white wine. One reason for this is because a stemware glass with a larger diameter bowl provides a larger surface area for the liquid in the bowl to interact with oxygen in the air, this process being commonly known as oxidation. Oxidation is generally considered to be desirable when drinking red wine because the complex flavors, oils, and spices present in red wine mature and meld after being exposed to air. In contrast, the bowl of many white wine glasses is narrower than that of red wine glasses which reduces the rate of oxidation. Reducing the rate of oxidation is generally thought to aid in containing the crisp, clean flavor that many white wines possess. Beyond the noticeable differences between the typical red wine stemware glass and a white wine stemware glass, other drinks customarily consumed from stemware glasses are designed to enhance the consumers' olfactory, visual, and taste senses during consumption such as champagne flutes, sherry glasses, brandy snifters, beer tulips, and beer goblets.

Stemware can be made of many different materials including transparent materials and opaque materials. Typically, stemware is made of transparent glass which allows the user of such stemware to visually inspect the color and clarity of the liquid that fills the bowl of such a stemware glass. Blown glass, fused glass and lead crystal are a just a few examples of materials of which stemware is made. Unfortunately, glass is breakable and one of the drawbacks to using glass stemware is its fragile nature where even a relatively minor impact of setting the stemware glass down or a hard surface may cause the stem to break separating the foot from the bowl making the glass unusable.

As another example, when consuming beer, the shape of the stemware will affect foam development and retention. The foam or head created by pouring beer into the stemware bowl acts as a net for compounds that evaporate from the beer to create its aroma, such as hop oils, yeast, fermentation byproducts, fusels, fruity esters, or other additives.

Further, the shape of stemware, including the narrowed upper flume, inherently precludes stacking of multiple glasses for space efficient storage. There exists, therefore, a need to make further improvements to many of the various forms of stemware which allows stemware to be more easily stored, protects stemware from damage during storage and transport, and stemware which can utilize replacement and customization parts all without sacrificing the benefits that stemware gives when consuming beverages. The present invention fulfills these needs and provides further related advantages.

My invention does not reside in any one of the identified features individually but rather in the synergistic combination of all of its structures, which give rise to the functions necessarily flowing therefrom as hereinafter specified and claimed.

SUMMARY

The following presents a simplified summary to provide a basic understanding of some aspects described herein. This summary is not an extensive overview of the disclosed subject matter. It is not intended to identify key or critical elements of the disclosed subject matter, or delineate the scope of the various embodiments. Its sole purpose is to present some concepts of the disclosed subject matter in a simplified form as a prelude to the more detailed description presented later.

A nesting stemware drinking vessel generally provides a base and a body that are dissimilar and releasably interconnectable.

In providing such a nesting stemware drinking vessel it is:

a principle object to provide a base and a body releasably interconnectable in at least two configurations, a first configuration resembling conventional stemware and a second configuration that minimizes the space required for storage of the base and body, eases transport and minimizes the risk of breakage when not in use.

a further object to provide a base of an integrally molded foot and stem.

a further object to provide a foot having plural locking protrusions.

a further object to provide a stem having a releasable connecting means at an end portion opposite the foot for releasably interconnecting the stem to the body.

a further object to provide a body having a bowl which has a generally parabolic shape defining an interior volume with an aperture having a circumferential edge that is rolled inwardly forming a lip having a smaller diameter than exterior diameter of the aperture.

a further object to provide a stem mount extending axially from exterior of the body opposite the aperture, where the stem mount includes a mating portion of releasable connecting means for releasable interconnection with the stem of the base.

a further object to provide a base and a body that are releasably interconnectable in a first configuration to form a conventional stemware drinking vessel.

a further object to provide a base and a body that are releasably interconnectable in a second configuration wherein the stem resides within the interior volume defined by the body.

a still further object to provide such a nesting stemware drinking vessel that is of new and novel design, of rugged and durable nature, of simple and economic manufacture and one that is otherwise well suited to the uses and purposes for which it is intended.

Other and further objects of my invention will appear from the following specification and accompanying drawings which form a part hereof In carrying out the objects of my invention it is to be understood that its structures and features are susceptible to change in design and arrangement with only one preferred and practical embodiment of the best known mode being illustrated in the accompanying drawings and specified as is required.

BRIEF DESCRIPTION OF THE DRAWINGS

In the accompanying drawings which form a part hereof and wherein like numbers refer to similar parts throughout.

DETAILED WRITTEN DESCRIPTION

Figure 1:
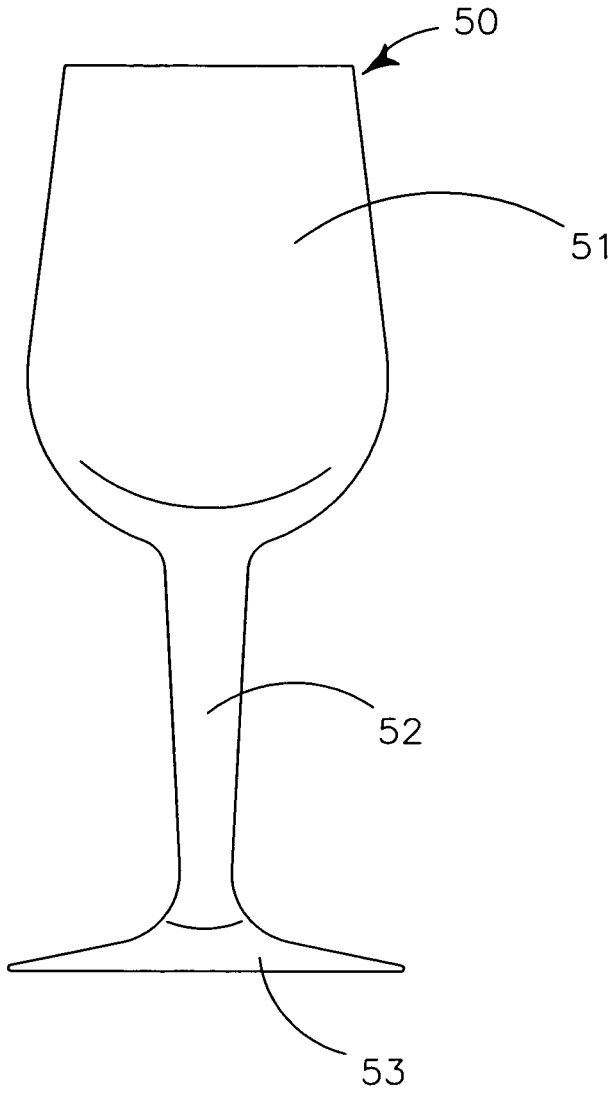
FIG. 1 PRIOR ART
FIG. 1 is an orthographic side view of an example of a prior art stemware drinking vessel.

As used herein, the term "bottom," its derivatives, and grammatical equivalents refers to the portion of my nesting stemware drinking vessel that is closest to a supporting surface. The term "upper," its derivatives, and grammatical equivalents refers to the portion of my nesting stemware glass that is most distant from the supporting surface. The term "outer," its derivatives, and grammatical equivalents refer to a portion of my nesting stemware drinking vessel that is distal from an axial center of the nesting stemware drinking vessel. The term "or" is intended to mean an inclusive "or" rather than an exclusive "or", that is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used herein and the appended claims are to be construed to mean "one or more" unless specified otherwise or clear from context to be directed to a singular form.

It is to be appreciated that various embodiments described herein can be implemented with variable shape, size, and volume in order to meet the demands of beverage connoisseurs while also providing the many benefits inherent with the subject disclosure.

It is to be further appreciated that this disclosure allows for a stemware drinking vessel made of transparent plastics such as, but not limited to polycarbonate, lexan, nalgene and the like that are characterized by high strength, light weight and break resistant qualities. In one embodiment, the subject disclosure allows for a stemware drinking vessel to be made of similarly break resistant but opaque materials such as but not limited to stainless steel. Aspects, features, or advantages of the various embodiments can be exploited in substantially any type of material conducive to the functionality described herein.

The preferred embodiment and alternate embodiments are now described with reference to the drawings, wherein like reference numerals are used to refer to like elements throughout.

My nesting stemware drinking vessel generally provides a body 34 and a base 10.

FIG. 1 illustrates an example of a known stemware drinking vessel 50 having three main sections: a bowl 51, a stem 52 and a foot 53 that are integral with one another. The stem 52 connects the bowl 51 with the foot 53. The foot 53 is typically designed to allow the stemware drinking vessel 50 to rest stably on a flat surface. It is to be appreciated that the shape of a stemware drinking vessel 50 is at least partially dependent upon the diameter of various sections of the bowl 51 which determine the generally parabolic shape of the bowl 51.

Figure 2:
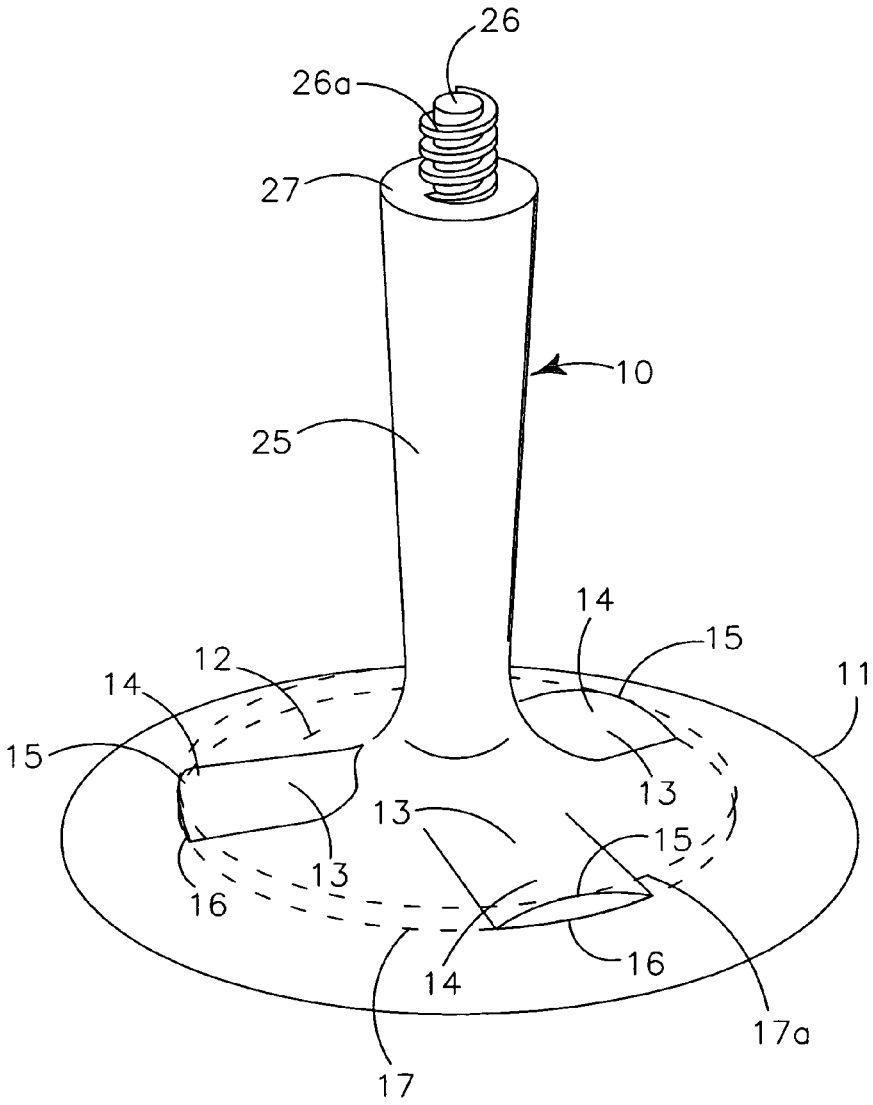
FIG. 2 is an isometric top and side view of a base of a nesting stemware drinking vessel in accordance with the present disclosure.

FIG. 2 illustrates a base 10 of a nesting stemware drinking vessel in accordance with the present disclosure. The base 10 includes a stem 25 which may be integrally formed with foot 11 to form a unitary structure. Upper surface 12 of the foot 11 has plural spacedly arrayed locking protrusions 13 that are incorporated into the upper surface 12 of the foot 11 and extend radially outwardly away from the stem 25. The plural locking protrusions 13 define a first circumference 17 that extends about the upper surface 12 of the foot 11 adjacent lower portions 16 of the locking protrusion 13 opposite the stem 25 and a second circumference 17*a* that extends about the upper surface 12 of the foot 11 proximate upper portions 15 of the locking protrusions 13 opposite the stem 25. The second circumference 17*a* is larger than first circumference 17.

In the preferred embodiment, base 10 has three spacedly arrayed locking protrusions 13; however it is to be appreciated that in alternative embodiments (not shown) plural spacedly arrayed locking protrusions 13 which may be two, or more than two, locking protrusions 13 could be included in alternate embodiments. End portion 14 of each locking protrusion 13 opposite the stem 25 is angled downwardly and inwardly such that upper portion 15 of locking protrusion 13 extends radially outwardly further from the stem 25 than lower portion 16 of the locking protrusion 13 adjacent the upper surface 12 of the foot 11.

Releasable attachment means 26, such as but not limited to, threads 26*a* are carried at end portion 27 of the stem 25 opposite the foot 11 to releasably interconnect the base 10 with the body 34. In the preferred embodiment, the releasable attachment means is threads 26*a*.

Figure 3:
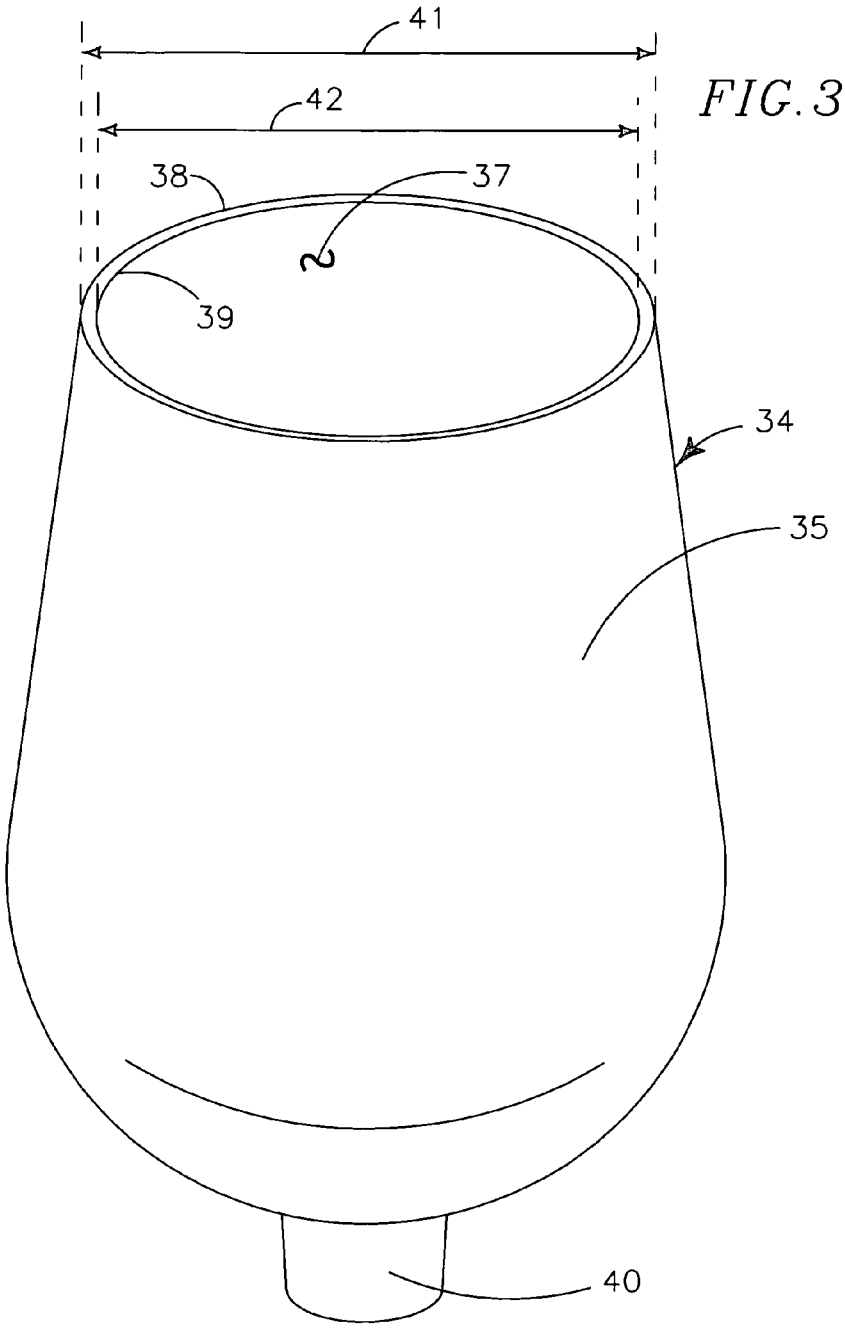
FIG. 3 an isometric top and side view of an opaque body of a nesting stemware drinking vessel in accordance with the present disclosure.
Figure 6:
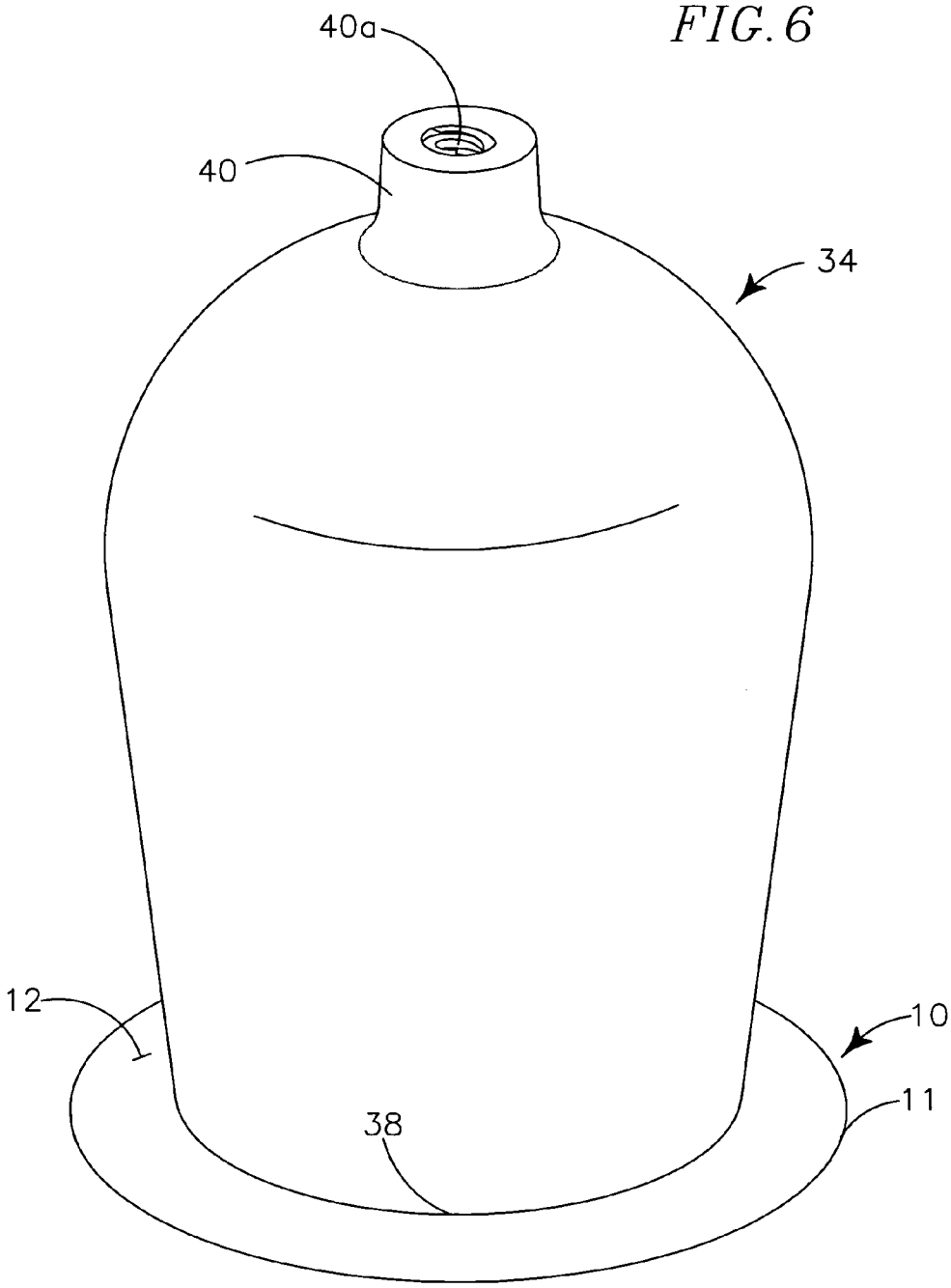
FIG. 6 is an isometric bottom and side view of the interconnected body and base of a stemware drinking vessel in a second nested configuration for storage and transport.

FIG. 3 illustrates body 34 of a nesting stemware drinking vessel in accordance with the present disclosure. The body 34 can include a bowl 35. Upper portion of the body 34 defines an aperture 36 below which is defined an interior volume 37 for containing liquid. The aperture 36 has a circumferential edge 38 that is rolled inwardly providing an inner circumferentially extruding lip 39 having a diameter 42 smaller than exterior diameter 41 of the aperture 36. (FIG. 3.) Diameter 42 of the lip 39 is substantially similar to the first circumference 17 encircling the lower portions 16 of the locking protrusions 13 carried on the upper surface 12 of the foot 11 which provides for frictional engagement between the lip 39 and the locking protrusions 13 to positionally maintain engagement of the base 10 with the body 34 while in a nested configuration. (FIG. 6).

Figure 5:
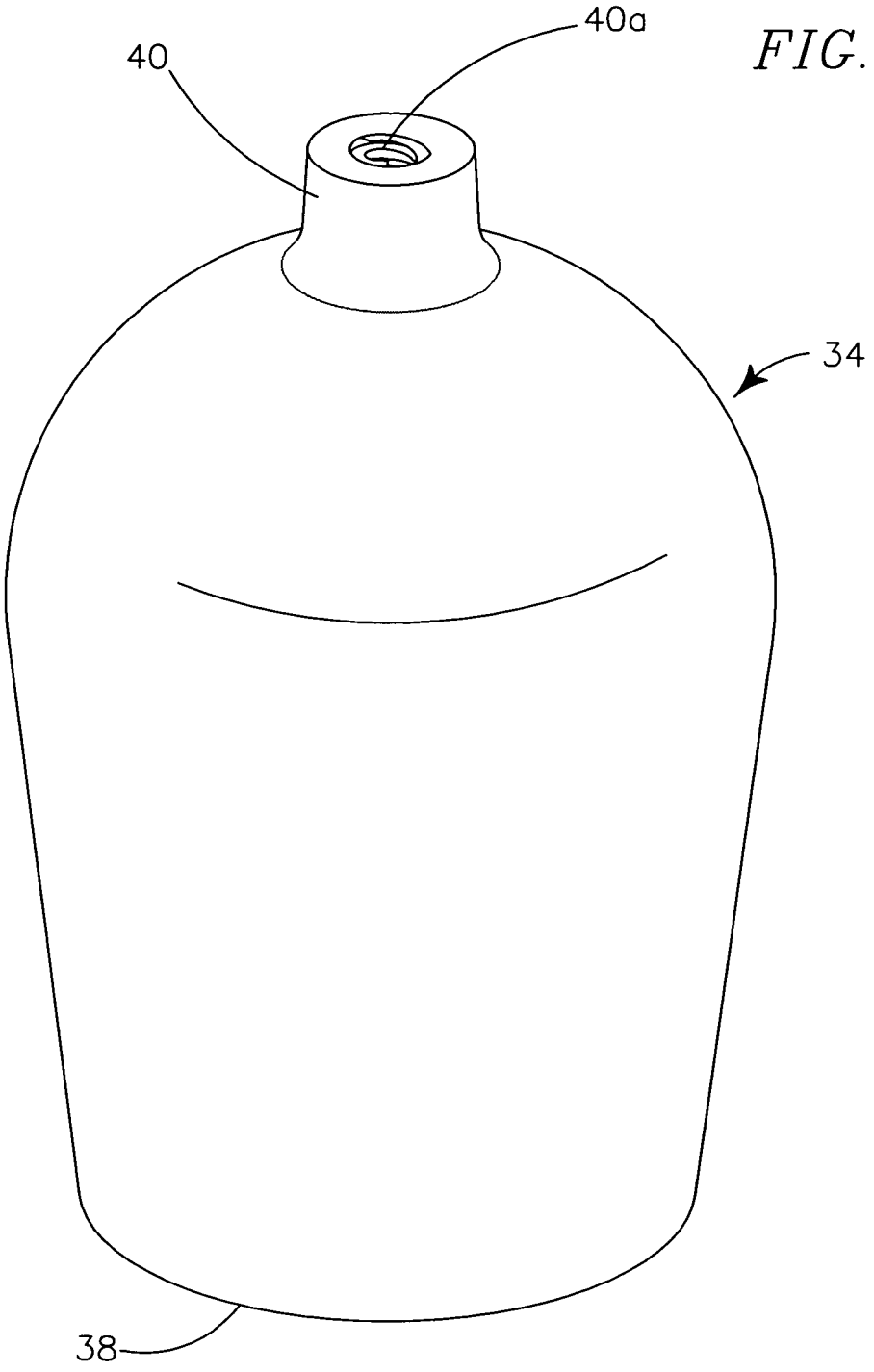
FIG. 5 is an isometric bottom and side view of the body of a nesting stemware drinking vessel of FIG. 3 shown in an inverted orientation.

As shown in FIG. 5, the body 34 has a stem mount 40 at lower exterior portion of the body 34 opposite the aperture 36. It is to be appreciated that the stem mount 40 can be structurally interconnected to the body 34 by any number of different techniques and alternatively the stem mount 40 may be integrally molded into the body 34. The stem mount 40 incorporates a mating portion of the releasable attachment means 26 carried by the stem 25. In the preferred embodiment, the stem mount defines threads 40*a* as the mating portion of the releasable attachment means 26.

It is to be appreciated that varying the dimensions of the body 34 such as the height, the depth, the diameter of the bowl 35, or the diameter of aperture 36, can alter the general shape and appearance of the body 34 and the nesting stemware drinking vessel without affecting its functionality. As such, varying the appearance of the body 34 and base 10 to serve various stemware markets is within the scope of the subject disclosure.

Figure 7:
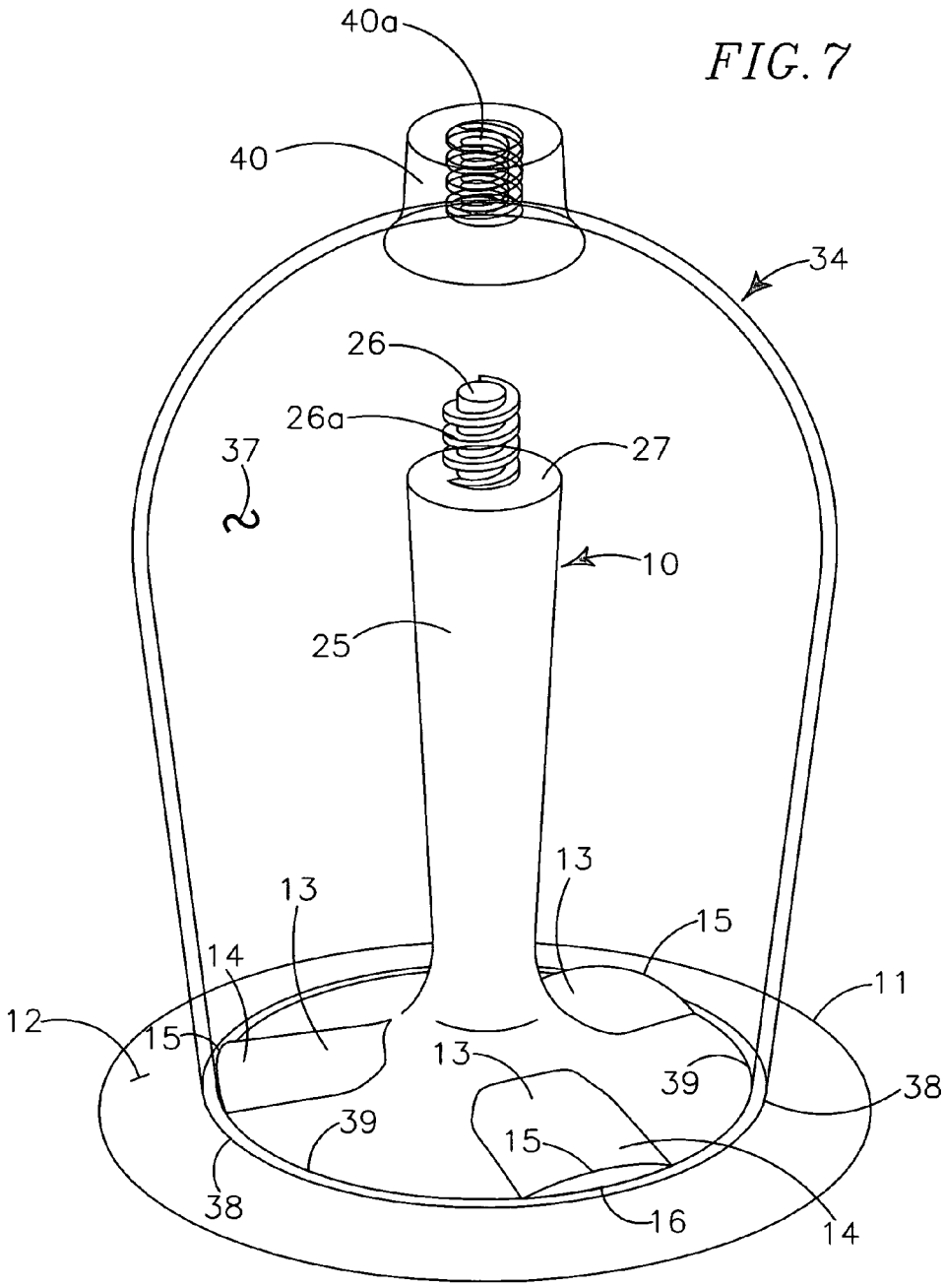
FIG. 7 is an isometric bottom and side view similar to the view of FIG. 6 showing the base nested within a transparent body.

FIG. 7 illustrates a view of a transparent nested stemware drinking vessel in accordance with the subject disclosure wherein frictional engagement of the locking protrusions 13 with the lip 39 causes the inverted body 34 to be positionally interconnected with the base 10. When nested, the stem 25, releasable attachment means 26, and locking protrusions 13 reside within the interior volume 37 defined by the body 34.

FIG. 6 illustrates a view of an opaque nested stemware drinking vessel in accordance with the present disclosure.

Figure 4:
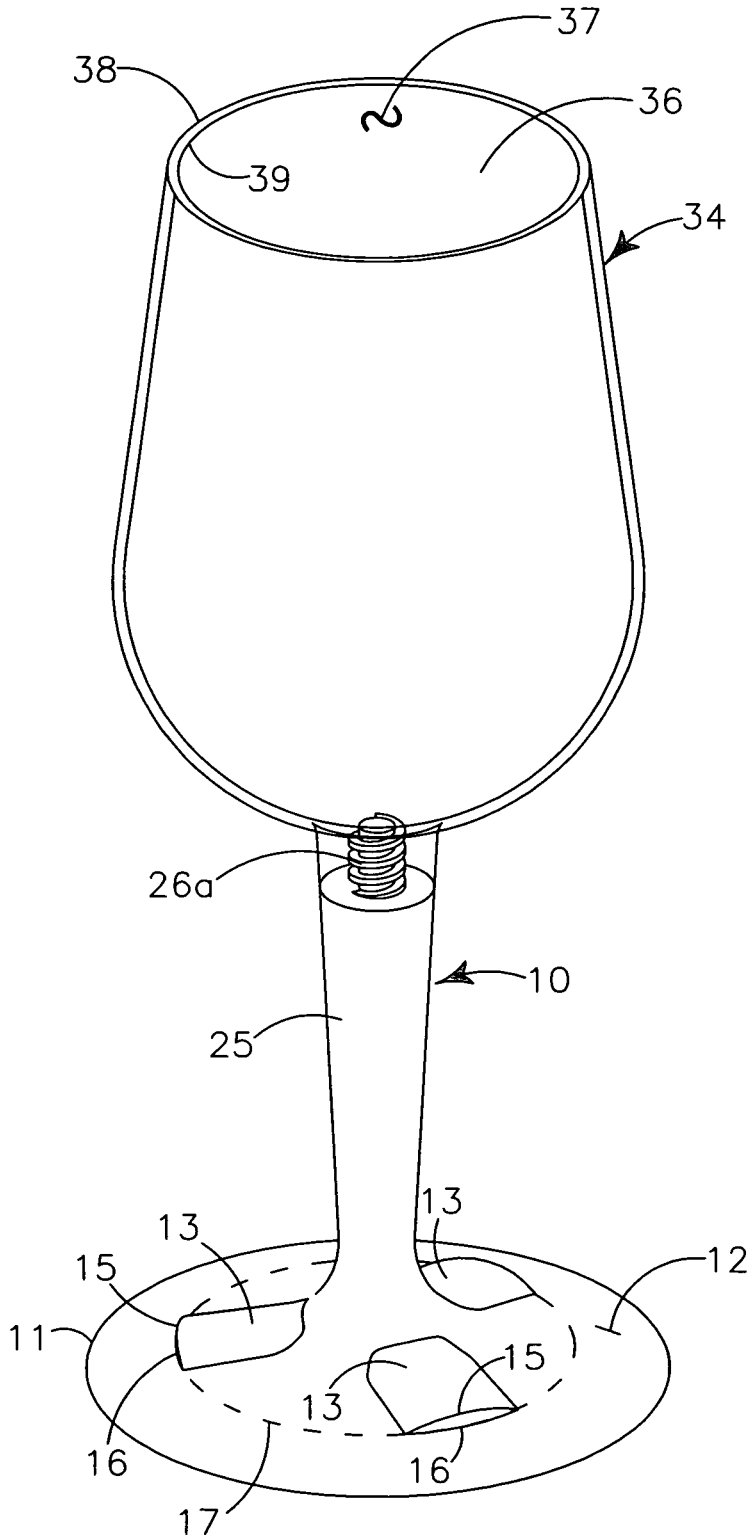
FIG. 4 is an isometric top and side view of a transparent body interconnected to a base in a first drinking configuration.

FIG. 4 illustrates a transparent nesting stemware drinking vessel in drinking configuration. In this configuration the base 10 is releasably connected to the body 34 to form a conventional stemware drinking vessel. The body 34 is attached to the base 10 by means of threads 26*a* that extend axially from upper end portion 27 of the stem 25 and the threads 40*a* defined by stem mount 40. It is to be appreciated that other methods of connecting the base 10 with the body 34 can exist to those skilled in the art such as, for example, male threads extending from the stem mount and female threads defined within the stem mount 40, snap-type friction connections (not shown), spring based connections (not shown) and the like.

Figure 8:
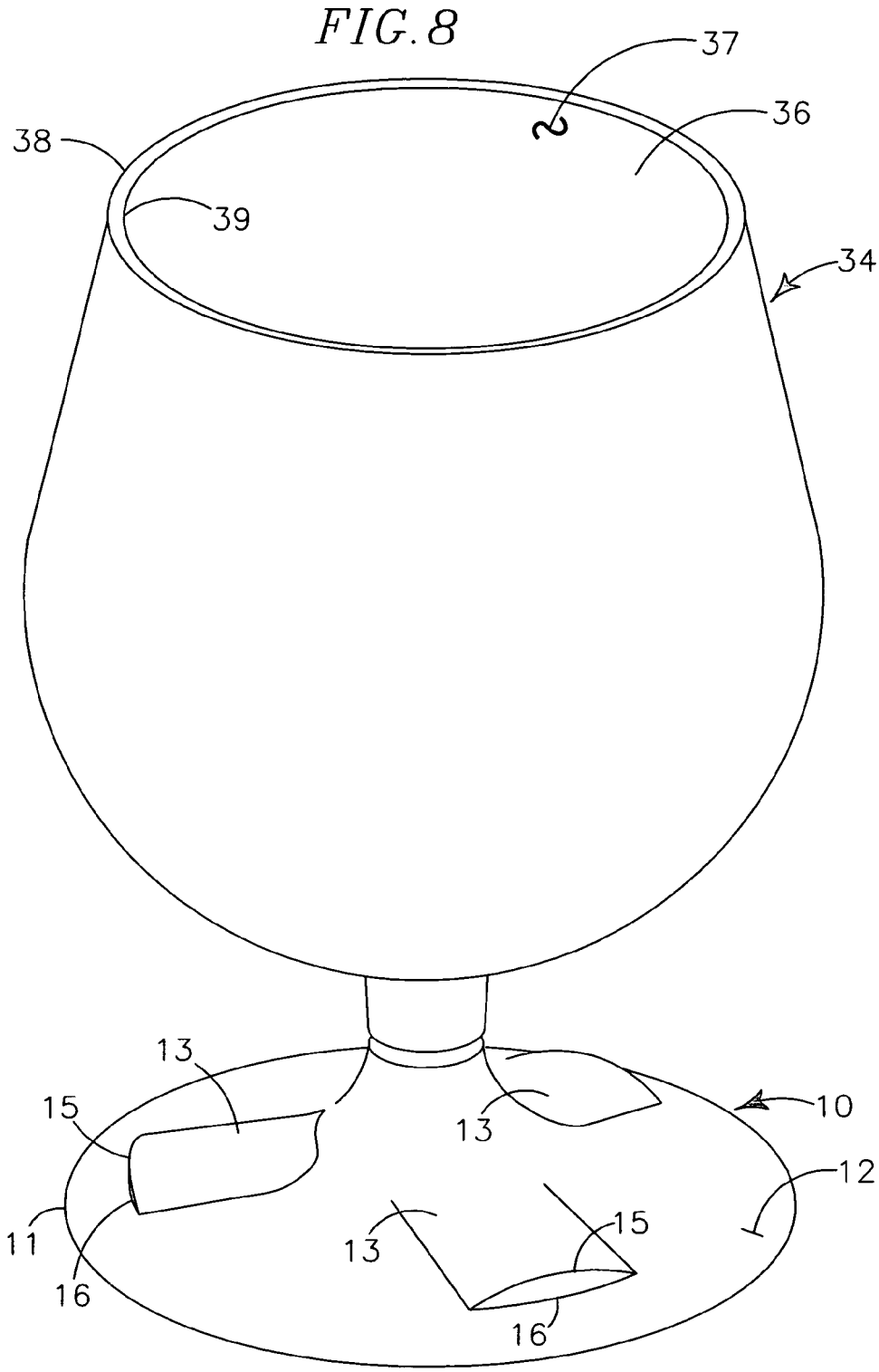
FIG. 8 is an isometric top and side view of an embodiment of a beer globe.

FIG. 8 illustrates a beer globe in a drinking configuration, having a different shaped body 34, a short stem 25 and a base 10 that is similarly detachable from the stem mount 40 and inverted to be carried within the aperture 36 defined by the body 34.

It is also to be appreciated that various embodiments described herein can be implemented with a number of different materials including where the body 34, the base 10, the stem 25 and foot 11 are made of different materials.

Having described the structure of my nesting stemware drinking vessel its operation may be understood.

The body 34 is interconnected with the base 10 by means of the mating portions 26*a*, 40*a* of the releasable interconnection 26 carried by the stem mount 40 and the upper end portion 27 of the stem 25 opposite the foot 11 to form a configuration similar to a known stemware drinking vessel that is suitable for containing liquids for drinking.

To change the nesting stemware drinking vessel from a drinking configuration (FIG. 4) to a nested configuration (FIG. 7) for storage and transport, the mating portions 26*a*, 40*a* of the releasable connecting means 26 are disconnected, such as by rotating the body 34 and base 10 axially in different directions. The body 34 is inverted relative to the base 10 and is positioned so that the stem 25 extends into the interior volume 37. The body 34 is forced axially downwardly onto the base 10 so that the lip 39 engages with and frictionally slides over upper portions 15 of the locking protrusions 13 to be positionally maintained at circumference 17 so that the upper portions 15 of the locking protrusions 13 frictionally engage with inner circumferential wall of the body 34 spacedly adjacent the circumferentially extending lip 39.

In the above description, for purposes of explanation, numerous specific details are set forth in order to provide a thorough understanding of the various embodiments. It may be appreciated, however, that the various embodiments can be practiced without these specific details. Additionally, numerous modifications and variations of the subject disclosure are expected to occur to those skilled in the art upon consideration of this detailed description. Moreover, it should be recognized that the configurations of the nesting stemware drinking vessel could be modified in an aesthetically pleasing way. As such, the subject disclosure may be embodied in many different forms and should not be construed as limited to the embodiments set forth herein; rather, these embodiments are provided so that this disclosure will be thorough and complete, and will fully convey the scope of the subject matter to those skilled in the art. Consequently, such modifications and variations are intended to be included within the scope of the subject disclosure.

Having thusly described my invention, what I desire to protect by Letters Patent, and what I claim is:

1. A two-piece nesting stemware drinking vessel comprising:

a unitary plastic base having a generally planar foot and a stem, the stem extending axially vertically from an upper surface of the foot, the foot having a diameter and an outer circumferentially extending edge and carrying three equally spaced apart integral locking protrusions protruding upwardly from the generally planar upper surface of the foot radially outward from the stem and spaced radially inwardly from the outer circumferentially extending edge of the foot;

a plastic parabolic body defining an interior volume having a closed lower end portion and an aperture opposite the closed lower end portion, the aperture having a radially inwardly rolled circumferentially extending lip having a diameter smaller than the diameter of the foot, and a stem mount carried on an exterior surface of the closed lower end portion opposite the aperture;

the radially inwardly rolled circumferentially extending lip capable of releasably snap engaging with the three equally spaced locking protrusions carried on the generally planar upper surface of the foot and spaced radially inwardly from the outer circumferential edge of the foot; and the stem mount capable of releasably engaging with the stem opposite the foot.

2. The two-piece nesting stemware drinking vessel according to claim 1 wherein:

the stem mount and the stem define mating portions of a releasable connection.

3. The two-piece nesting stemware drinking vessel according to claim 1 wherein:

an arc formed by the radially outward end portions of the three equally spaced apart locking protrusions integral with and extending upwardly from the top surface of the foot has a diameter that is the same as the diameter of the radially inwardly rolled circumferentially extending lip of the aperture and smaller than the diameter of the foot.

4. The two-piece nesting stemware drinking vessel according to claim 1 wherein:

when the radially inwardly rolled circumferentially extending lip and the radially outer end portions of the three equally spaced locking protrusions are engaged, the locking protrusions are entirely within the interior volume defined by the body and the outer circumferential edge of the foot extends radially outward from an outer circumference of the aperture.

5. The two-piece nesting stemware drinking vessel according to claim 1 wherein:

radially outward end portions of the three equally spaced apart locking protrusions are angled such that an upper portion of each of the three equally spaced apart locking protrusion extends further radially outwardly from the stem than a lower portion of the locking protrusion immediately adjacent the upper surface of the foot providing a ledge to releasably engage with the radially inwardly rolled lip of the body.

6. A two-piece nesting stemware drinking vessel comprising in combination:

a unitary plastic body and a unitary plastic base that are releasably interconnectable in a first drinking configuration and in a second storage configuration wherein a stem and three equally spaced locking protrusions are integrally carried upon a top surface of the base spacedly radially inward from an outer circumferential edge of the base and entirely within a volume defined by the body;

the unitary plastic body is parabolic defining the volume having a closed lower end portion and an aperture opposite the closed lower end portion, the aperture having an inner circumferentially extending radially inwardly rolled lip having a smaller diameter than exterior diameter of the aperture;

the stem mount formed of the same material as the body integrally carried on an exterior surface of the body's closed lower end portion opposite the aperture, the stem mount carrying one portion of a releasable connecting means;

the base is unitary and is formed of plastic and has a generally planar and peripherally circular foot having a diameter and an outer circumferentially extending edge and a stem;

the stem extending axially from an upper surface of the foot and carrying a second portion of a releasable connecting means opposite the foot for releasable engagement with the releasable connecting means of the body;

three equally spaced locking protrusions integral with the upper surface of the foot radially outward from the stem and radially spacedly inward from the outer circumferentially extending edge of the foot, a radially outermost portion of each of the three locking protrusions is angled radially inwardly and downwardly toward the upper surface of the foot and inwardly toward the stem so that a radially upper outer end portion of each of the three equally spaced apart locking protrusions extends further radially outwardly from the stem than a lower portion of the locking protrusion immediately adjacent the upper surface of the foot;

an arc formed by the radially outer end portions of the three equally spaced apart locking plural protrusions immediately adjacent the top surface of the foot has a diameter that is the same as a diameter of the inner circumferentially extending radially inwardly rolled lip and smaller than the diameter of the foot;

the inner circumferentially extending radially inwardly rolled lip releasably engages with the three locking protrusions when the drinking vessel is in the second storage configuration such that the three equally spaced apart locking protrusions are entirely within the volume defined by the body; and the releasable connecting means carried by the stem releasably engages with the releasable connecting means carried by the stem mount when the drinking vessel is in the first drinking configuration.

7. A two-piece nesting stemware drinking vessel comprising:

a unitary plastic base having a generally planar foot and a stem, the stem extending axially vertically from an upper surface of the foot, the foot having a diameter and an outer circumferentially extending edge and carrying three equally spaced apart integral locking protrusions protruding upwardly from the generally planar upper surface of the foot radially outward from the stem and spaced radially inwardly from the outer circumferentially extending edge of the foot;

a stainless steel parabolic body defining an interior volume having a closed lower end portion and an aperture opposite the closed lower end portion, the aperture having a radially inwardly rolled circumferentially extending lip having a diameter smaller than the diameter of the Foot, and a stem mount carried on an exterior surface of the closed lower end portion opposite the aperture;

the radially inwardly rolled circumferentially extending lip capable of releasably snap engaging with the three equally spaced locking protrusions carried on the generally planar upper surface of the foot and spaced radially inwardly from the outer circumferential edge of the foot; and the stem mount capable of releasably engaging with the stem opposite the foot.

* * * * *